US005623874A

United States Patent [19]

Ruprecht

[11] Patent Number: 5,623,874

[45] Date of Patent: Apr. 29, 1997

[54] COUNTER-PRESSURE MEANS FOR EFFECTUATING PERFORATIONS AND/OR PUNCHINGS AT OFFSET SHEET PRINTING MACHINES

[75] Inventor: Daniel Ruprecht, Heimiswil, Switzerland

[73] Assignee: Ruprecht Handels AG, Krauchthal, Switzerland

[21] Appl. No.: 540,662

[22] Filed: Oct. 11, 1995

Related U.S. Application Data

[63] Continuation-in-part of Ser. No. 389,203, Feb. 15, 1995, abandoned.

[30] Foreign Application Priority Data

Apr. 14, 1994 [CH] Switzerland ..... 01147/94

[51] Int. Cl.[6] ..... B41F 9/00

[52] U.S. Cl. ..... 101/142; 101/226

[58] Field of Search ..... 101/401.1, 415.1, 101/136, 141, 246, 409, 226, 227, 142; 492/48, 49, 53, 54

[56] References Cited

U.S. PATENT DOCUMENTS

| | | | |
|---|---|---|---|
| 3,926,118 | 12/1975 | Preuss | 101/246 |
| 4,178,402 | 12/1979 | Klapproth et al. | 101/401.1 |
| 4,598,641 | 7/1986 | Fischer | 101/409 |
| 4,854,237 | 8/1989 | Theilacker | 101/415.1 |

FOREIGN PATENT DOCUMENTS

| | | |
|---|---|---|
| 4138278A1 | 5/1993 | Germany . |
| 95/08444 | 3/1995 | WIPO . |

*Primary Examiner*—Ren Yan
*Attorney, Agent, or Firm*—Richard Linn

[57] ABSTRACT

A counter-pressure apparatus for offset sheet machines for effectuating perforations and/or punchings comprises a foil provided with strips at two opposing of its edges. This foil is arranged for being fastened within fixing structure of a rubber blanket cylinder or of a forme cylinder of a printing group or of a coating module of the printing machine. The use of the foil, made e.g. of chronium steel, instead of a prior art rubber blanket results in much better perforations or punching apertures. Further, the printing machine can maintain its usual printing speed.

15 Claims, 2 Drawing Sheets

COUNTER-PRESSURE MEANS FOR EFFECTUATING PERFORATIONS AND/OR PUNCHINGS AT OFFSET SHEET PRINTING MACHINES

BACKGROUND OF THE INVENTION

The present application is a continuation in part of patent application with Ser. No. 08/389,203 filed on Feb. 15, 1995 for the same applicant, now abandoned The present invention relates to a counter-pressure means for effectuating perforations and/or punchings at offset sheet printing machines.

Offset printing machines comprise an impression cylinder—also called counter-impression cylinder—and a cooperating rubber blanket cylinder. The rubber blanket cylinder is provided with a rubber blanket and is pressed against the impression cylinder with a definite pressure. For effectuating perforations it is known to mount a perforating ribbon on the impression cylinder whereas the rubber blanket is left unchanged on the blanket cylinder. However, the rubber blanket presents the disadvantage during perforation that it does not allow an optimal perforating due to its softness, and that it limits the operational speed of the entire printing group and of optionally connected further printing groups. Furthermore, the sheets are deformed by the rubber blanket during perforating in such a manner that no correct sheet stack can be built up afterwards. The same effect arises during effectuating punchings, because the rubber blanket is to flexible.

It is known in practice that often no printing group is free for perforating and/or punching. Consequently, these processes have to wait. It is therefore desirable with offset printing machines comprising additional groups, e.g. a coating module, to use such a module for perforating and/or punching.

U.S. Pat. No. 4,178,402 discloses a multi-ply cylinder blanket for offset printing machines enabling, according to this patent, high quality printing. However, those blankets are not suitable for perforations or punchings since the surface of the blankets is made of rubber, besides the fact that for effectuating perforations the complicated construction of the multi-ply blanket is far too cost intensive.

U.S. Pat. No. 4,854,237 further discloses a holding arrangement to use for printing machine cylinder underlays with a magnetic foil strip.

Starting from this prior art, it is an object of the present invention to provide for a counter-pressure means for effectuating perforations and/or punchings with offset sheet printing machines allowing higher passing rates and higher quality perforations and/or punchings.

It is a further object to provide for a possibility to use auxiliary groups of the offset printing machines, especially coating modules, for this purpose.

SUMMARY OF THE INVENTION

The first object is attained in that the means comprises a foil provided with strips at two opposing of its edges, the foil and strips being executed for being fastened within fixing means of either a rubber blanket cylinder of a printing group of the printing machine or of a forme cylinder of an auxiliary coating module of the printing machine.

In a preferred embodiment, the foil comprises an underlying blanket at its underside or its upper side in order to achieve a total thickness which corresponds to the thickness of the known, usual rubber blanket.

In the following, the invention will be explained in more detail by means of a drawing of an embodiment.

DETAILED DESCRIPTION OF THE INVENTION

Figure 1:
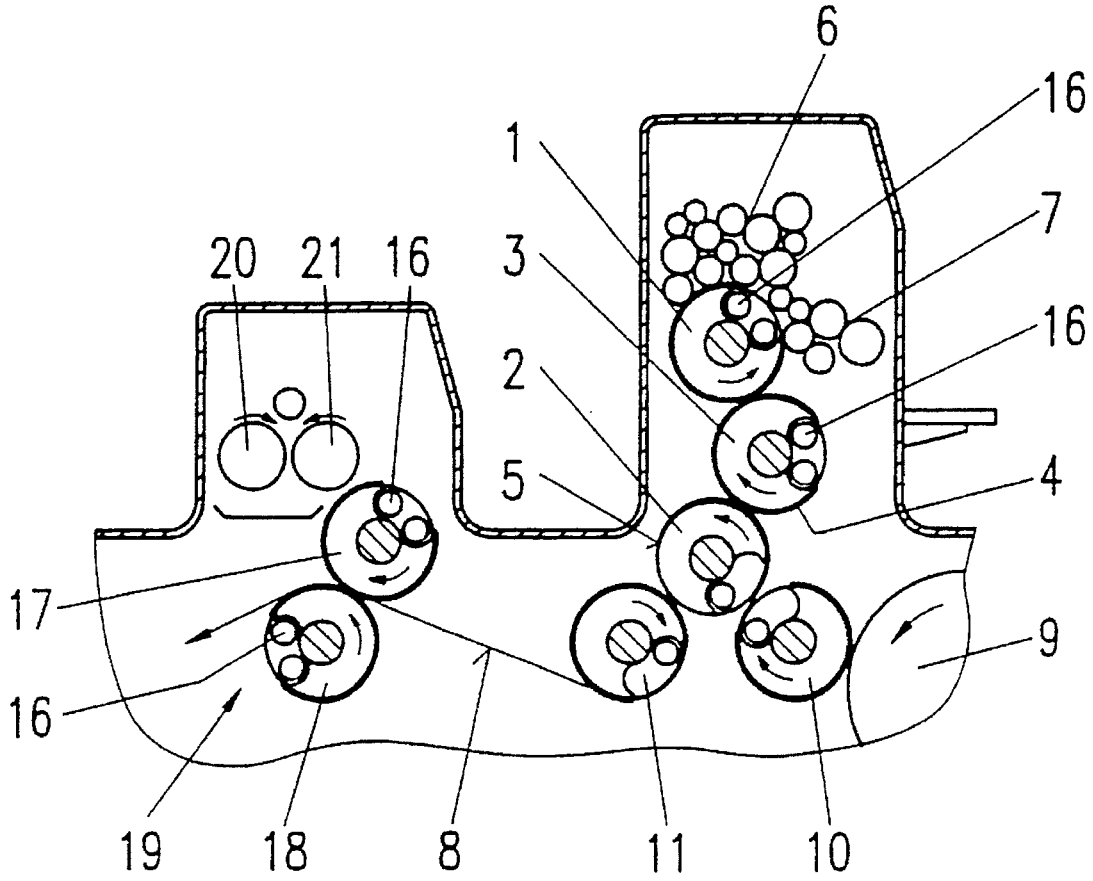
FIG. 1 schematically shows the arrangement of a printing group and a coating module of an offset sheet printing machine.

FIG. 1 shows in a schematical manner one printing group of optionally several printing groups of an offset sheet printing machine, comprising a plate cylinder 1, an impression cylinder 2, and a rubber blanket cylinder arranged between these two cylinders. On the rubber blanket cylinder 3 is mounted a foil 4 instead of a rubber blanket. However, if the printing group is used for printing and not for perforating, an usual rubber blanket is mounted on the rubber blanket cylinder 3. For effectuating perforations, a perforating ribbon 5 is mounted on the impression cylinder 2, see FIG. 3, which teeth are showwing in the direction of the rubber blanket cylinder 3 in order to perforate the paper running between these two cylinders. For the punching, suitable means are mounted on impression cylinder 2.

The use of a foil as a back-pressure means, where the foil is f. ex. of chromium steel, does not only yield a better, more clear cut perforation or punching of the paper, but before all, it also allows to maintain the normal printing speed of the offset sheet presses, so that printing and perforating can be effectuated with the same, unchanged high speed. Until now this has been impossible because the rubber blankets used hitherto do not allow such high speeds, and therefore the operational speed had to be reduced for this process step.

FIG. 1 further shows an inking system 6 and a dampening system 7. These systems comprise different rollers which transfer printing ink or water on the plate cylinder 1, respectively. The paper sheets 8 pass from an intermediate drum 9 to a first feed drum 10, then on the impression cylinder 2 and afterwards to a second feed drum 11. From this drum 11 the sheets are optionally passed to a further drum and, if provided, to another printing group or a coating module 19.

Figure 3:
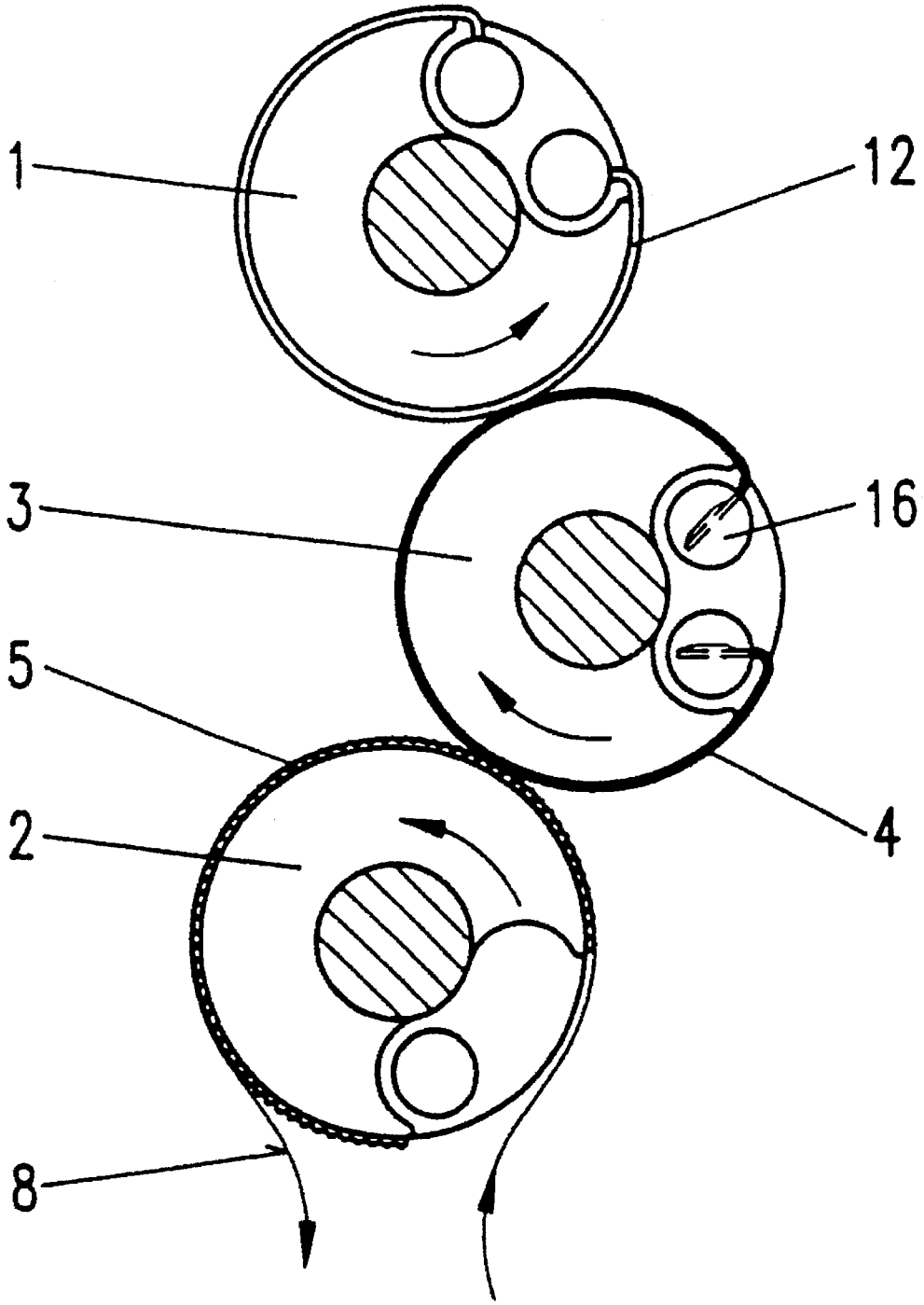
FIG. 3 shows a detail of FIG. 1 at an enlarged scale.

FIG. 3 shows a cross-sectional view of the plate cylinder 1, the impression cylinder 2 and the rubber blanket cylinder 3 at an enlarged scale. The plate cylinder 1 comprising a printing plate 12 mounted thereon is well known, being differently constructed dependent on the various machine types. In the present embodiment, the perforating ribbon 5 is mounted on the impression cylinder 2 as usual with known printing groups. The fixation of the perforating ribbon 5 can be realised in longitudinal or transverse direction. The rubber blanket cylinder 3 is provided, according to the invention, with the foil 4 in the case where perforating is to be effected.

In case where the coating module 19 is to be used for perforating and/or punching, foil 4 is mounted on a forme cylinder 17. The perforating ribbon 5 is mounted on a second cylinder, an impression cylinder 18. Both cylinders 17 and 18 comprise similar fixing means 16 with strips 13 as are usual with the plate cylinder 1 and rubber blanket cylinder 3. FIG. 1 further shows a metering roller 20 and a coating forme roller 21, which during perforating or punching processes are evidently not cooperating with the forme cylinder 17. Beneath the rollers 20, 21 is shown a coating drip pan.

Figure 2:
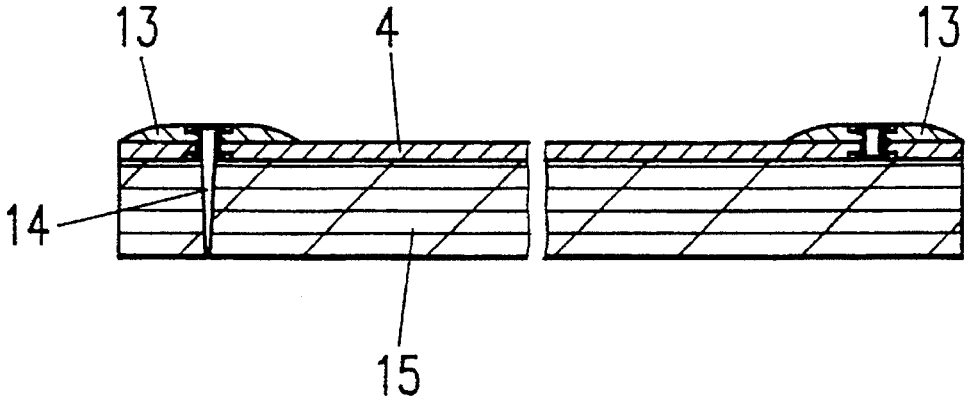
FIG. 2 shows a sectional view of the metal foil of this invention, provided with strips.

According to FIG. 2 the foil 4 is bordered by two opposing strips 13 which are cemented and/or riveted to the foil. If no perforations or punchings are to be made, an usual rubber blanket is fastened on the rubber blanket cylinder 3, and the perforating ribbon 5 is of course removed. The dressing of the rubber blanket cylinder 3 has a defined standard thickness according to the printing product, so that there is a so called disposal pressure between the rubber blanket cylinder 3, and the therewith cooperating impression cylinder 2. It is clear that the foil 4 which replaces the rubber blanket should have about the same thickness, under consideration of the perforating ribbon 5 or punching means. The same applies equally for the coating module 19.

Since such a thick foil 4 is not necessary and could be fastened on the cylinder only with difficulties, a thin metal foil having a thickness of about 0.3 mm for example is used. In order to achieve the—for European countries—standard thickness of 1.95 mm, an underlying blanket 15 having a thickness of 1.65 mm is spread under the foil. This underlying blanket may have a variable stiffness adapted to the intended use, and e.g. may be a pressboard plate. It is appropriate to fasten the underlying board at one end only, as symbolyzed by the longer rivet 14 in FIG. 2. The board however may be fastened at both ends or be fixed at the foil. It is evident, that other standard thicknesses may be utilized.

In order to spare the foil, it may be convenient to mount on its top side a relatively tough sheet, for example of synthetic material, which can be replaced when necessary by a new sheet. Of course, the total thickness must remain the same as that of the corresponding rubber blanket.

The strips 13 are the same as those which are used for fixing the rubber blanket. Therefore, the fixing means 16 of the rubber blanket cylinder 3 remains the same as the already known one. When the foil 4 is used for perforating, including the optional covering and/or underlying blanket 15, modifications on the printing groups or the coating module 13 need not be made.

The material of the foil 4 may be metal, e.g. chromium steel, or an other suitable metal or a suitable plastic or synthetic material.

It should furthermore be noted that, besides the advantages already mentioned, a further advantage in using the foil 4 is that the sheets are not deformed during perforating or punching. Therefore, the entire stack can be piled up in the same manner as before the perforation or punching. Its transportation is thus considerably facilitated, in contrast to the strongly deformed sheets after perforating using a rubber blanket. Therefore, it is also possible to use foil 4 for punching of different patterns, e.g. address areas.

I claim:

1. An offset sheet printing machine having an arrangement for punching and/or perforating paper sheets (8), comprising:

a printing group having a first printing cylinder (2) and an allocated rubber blanket cylinder (3);

a varnishing group (19) having a second printing cylinder (18) and an allocated forming cylinder (17), one of said rubber blanket cylinder (3) and said forming cylinder (17) being equipped with fixing means (16) for fastening a foil layer thereto, and a perforating ribbon (5) being fixed on the first printing cylinder (2) or the second printing cylinder (18);

wherein a counter-pressure means is provided on one of said rubber blanket cylinder (3) and said forming cylinder (17), said counter-pressure means being allocated to the printing cylinder (2, 18) with said perforating ribbon (5) fixed thereon for effecting perforations and/or punchings in paper sheets (8), said counter-pressure means comprising a layer fixed on said one of said rubber blanket cylinder (3) and said forming cylinder (17), said layer being a combination of an inner underlying blanket (15) of hard material and an outer resistant foil (4).

2. The machine according to claim 1, wherein the total thickness of said combination of said underlying blanket (15) and said foil (4) corresponds to the thickness of a rubber blanket conventionally used with said rubber blanket cylinder (3).

3. The machine according to claim 1, wherein said layer is fixed at one of its ends.

4. The machine according to claim 1, wherein said layer is fixed at both of its ends.

5. The machine according to claim 1, wherein said underlying blanket (15) is a pressboard plate.

6. The machine according to claim 1, wherein said outer resistant foil (4) consists of metal.

7. The machine according to claim 6, wherein said metal is chromium steel.

8. The machine according to claim 1, wherein said outer resistant foil (4) consists of a synthetic material.

9. The machine according to claim 1, wherein said layer further comprises a tough sheet mounted on the topside of said resistant foil (4).

10. The machine according to claim 1, wherein a thickness of said foil (4) is approximately 0.3 mm, and a thickness of said underlying blanket (15) is approximately 1.65 mm.

11. A cylinder for an offset sheet printing machine, comprising:

counter-pressure means for effectuating perforations and/or punchings, said counter-pressure means comprising a layer fixed on said cylinder, said layer being a combination of an inner underlying blanket of hard material and an outer resistant foil, said foil having two opposing edges and strips provided at said two opposing edges, said foil and strips being fastened within fixing means of said cylinder so as to form a hard outer foil surface over said cylinder.

12. The cylinder according to claim 1, wherein the total thickness of said foil and said underlying blanket corresponds to the thickness of a rubber blanket conventionally used with said cylinder.

13. The cylinder according to claim 1, wherein said foil consists of metal.

14. The cylinder according to claim 1, wherein said underlying blanket is a pressboard plate.

15. The cylinder according to claim 11, wherein a thickness of said foil (4) is approximately 0.3 mm, and a thickness of said underlying blanket (15) is approximately 1.65 mm.

* * * * *